US008113031B2

(12) United States Patent
Battenfeld et al.

(10) Patent No.: US 8,113,031 B2
(45) Date of Patent: Feb. 14, 2012

(54) CRIMPING TOOL

(75) Inventors: Kurt Battenfeld, Ebsdorfergrund (DE); Thomas Glockseisen, Düsseldorf (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 460 days.

(21) Appl. No.: 12/348,575

(22) Filed: Jan. 5, 2009

(65) Prior Publication Data

US 2009/0173133 A1 Jul. 9, 2009

(30) Foreign Application Priority Data

Jan. 8, 2008 (DE) ..... 10 2008 003 524

(51) Int. Cl.
*B21H 1/14* (2006.01)

(52) U.S. Cl. ..... 72/402; 72/409.1; 72/409.01

(58) Field of Classification Search ..... 72/402, 72/409.11–409.18, 416, 120, 121, 270, 409.1, 72/409.12; 81/57, 58, 100, 108, 168, 140, 81/315, 317, 342, 345, 346, 349, 353, 393, 81/446, 454, 455, 478
See application file for complete search history.

(56) References Cited

U.S. PATENT DOCUMENTS

| | | | | |
|---|---|---|---|---|
| 2,985,047 A | | 5/1961 | Van Oort | |
| 3,126,750 A | | 3/1964 | Willis | |
| 3,156,139 A | * | 11/1964 | Willis | 72/402 |
| 3,201,969 A | | 8/1965 | Harrison, et al. | |
| 3,212,315 A | | 10/1965 | Lee | |
| 3,492,854 A | | 2/1970 | Eppler | |
| 4,144,737 A | * | 3/1979 | Izraeli | 72/409.11 |
| 4,720,911 A | | 1/1988 | Tubman | |
| 4,987,722 A | * | 1/1991 | Koebbeman | 53/353 |
| 5,187,968 A | | 2/1993 | Beetz et al. | |
| 5,261,263 A | * | 11/1993 | Whitesell | 72/409.19 |
| 5,913,933 A | | 6/1999 | Beetz et al. | |
| 6,151,950 A | | 11/2000 | Wilhelm et al. | |
| 6,173,466 B1 | | 1/2001 | Chen | |

(Continued)

FOREIGN PATENT DOCUMENTS

CH 402 099 5/1966

(Continued)

OTHER PUBLICATIONS

European Search Report in co-pending, related EP Application No. 08172803.2, mailed Apr. 19, 2011.

*Primary Examiner* — Dana Ross
*Assistant Examiner* — Homer Boyer
(74) *Attorney, Agent, or Firm* — Thomas, Kayden, Horstemeyer & Risley, LLP

(57) ABSTRACT

The present invention relates to crimping pliers for crimping connecting elements. The crimping pliers comprise crimping jaws building a nest for the connecting element. The crimping jaws are designed and arranged for being moved in radial direction versus a longitudinal axis of the nest for applying radial crimping forces upon the connecting element. Hand levers are provided for manually applying the crimping forces and causing the movement of said crimping jaws. The hand levers are located in a plane. The plane is aligned with the longitudinal axis of said nest and divided by the longitudinal axis into two half-planes. Both of said hand levers are located in one and the same half-plane. A transfer or transmission unit transfers a translational activation along the longitudinal axis in the force flow between said hand levers and said crimping jaws into a rotational activation around the longitudinal axis.

16 Claims, 15 Drawing Sheets

U.S. PATENT DOCUMENTS

| | | | | |
|---|---|---|---|---|
| 6,176,116 | B1 | 1/2001 | Wilhelm et al. | |
| 6,289,712 | B1 * | 9/2001 | Beetz et al. | 72/409.16 |
| 6,612,039 | B2 * | 9/2003 | Kakiuchi et al. | 30/392 |
| 6,629,443 | B2 * | 10/2003 | Chin | 72/409.12 |
| 6,925,847 | B2 * | 8/2005 | Motsenbocker | 72/402 |

FOREIGN PATENT DOCUMENTS

| | | | |
|---|---|---|---|
| DE | 40 39 435 | C1 | 6/1992 |
| DE | 40 26 332 | C2 | 7/1992 |
| DE | 41 01 284 | C2 | 11/1992 |
| DE | 42 41 971 | C1 | 12/1993 |
| DE | 42 41 224 | C1 | 1/1994 |
| DE | 195 07 347 | C1 | 9/1996 |
| DE | 197 13 580 | A1 | 10/1998 |
| DE | 198 18 482 | C1 | 11/1999 |
| DE | 101 40 270 | B4 | 9/2004 |
| EP | 0 471 977 | B1 | 6/1995 |
| FR | 1039515 | | 10/1953 |

* cited by examiner

CRIMPING TOOL

CROSS REFERENCE TO RELATED APPLICATIONS

This application claims priority to co-pending German Patent Application No. DE 10 2008 003 524.6 entitled "Presswerkzeug", filed Jan. 8, 2008.

FIELD OF THE INVENTION

The present invention generally relates to a crimping tool for crimping work pieces. Such crimping tool might be crimping or pressing pliers. These crimping tools might be used for pressing or crimping connecting elements, e.g. cable shoes, contact sleeves, plugs, cable end sleeves for electrical conduits, tubes or fittings for tube connections and the like. Depending on the design of the work piece to be crimped (especially in case of fitting or tubes) substantial pressing forces have to be applied upon the work piece. More particular, the present invention relates to pliers which are operable with one hand and which serve to apply great crimping forces onto the work piece in one or a few crimping steps.

BACKGROUND OF THE INVENTION

The prior art discloses two different types of activating crimping tools:

a) For a first type of activation, e.g. described in German Patent No. DE 195 07 347 C1 corresponding to U.S. Pat. No. 6,176,116, hand levers are pivoted in a plane of the pliers wherein a leveled head of the pliers as well as the crimping jaws are also located in that plane. The connecting element to be crimped and an electric wire inserted into the connecting element are introduced into a nest built by the crimping jaws. The connecting element and the wire are inserted into the nest in a direction perpendicular to the aforementioned plane. With the movement of the hand levers, the crimping jaws move in the aforementioned plane towards each other and versus the longitudinal axis of the connecting element.

b) According to a second way of activating the crimping tools, e.g. disclosed in German Patent No. DE 40 26 332 C2 corresponding to European Patent No. EP 0 471 977 B1, German Patent No. DE 40 39 435 C1 corresponding to U.S. Pat. No. 5,187,968, or German Patent No. DE 198 18 482 C1 corresponding to U.S. Pat. No. 6,151,950, the hand levers and the leveled head of the pliers also extend in one common plane as for the variant a). However, here the connecting element is not introduced perpendicular to the aforementioned plane into the nest built by the crimping jaws. Instead, the connecting element is introduced into the front surface of the head of the pliers, wherein the longitudinal axis of the connecting element as well as the direction of introduction of the connecting element into the nest built by the crimping jaws lies in the aforementioned plane. The longitudinal axis of the nest and of the connecting element housed in the nest is aligned with the middle axis of the two hand levers.

Due to the different mechanisms used for transferring and converting the force between the hand levers and the crimping jaws for crimping pliers according to variant a), a plurality of crimping jaws has to be used, wherein in particular the number of the crimping jaws coincides with the number of the corners of the cross-section of the connecting element at the end of the crimping process. Instead in the transfer mechanism for the force used for pliers according to variant b), only two crimping jaws are used, wherein for such variant each crimping jaw (or a die connected with each of the crimping jaws) determines a plurality of contour lines of the contour formed in the connecting element at the end of the crimping process. In general, for variant b) one crimping jaw or die determines a half-contour of the crimping contour. Often crimping pliers according to variant b) use a trapezoidal contour of the crimping surfaces of the crimping jaws or dies.

A crimping tool with a pistol-shaped design is known from U.S. Pat. No. 3,201,969. The housing comprises an L-shaped angled handle having an activation element similar to the trigger of a pistol. Via the activation element, a valve might be switched such that a pneumatic pressure is fed to a piston. The activated piston is moves in axial direction. Such axial movement is converted by a toggle mechanism into a radial crimping movement of crimping elements. These crimping elements radially crimp a work piece introduced into the nest of the crimping tool located at the muzzle of the pistol. U.S. Pat. No. 3,201,969 also mentions an embodiment, wherein the crimping movement is manually caused by a finger pressing an activation element instead of the aforementioned pneumatic activation. However, U.S. Pat. No. 3,201,969 does not explain how to provide the necessary large crimping forces for manual activation with one single finger.

German Patents Nos. DE 42 41 224 C1, DE 41 01 284 C2 and U.S. Pat. No. 6,173,466 B1 also disclose crimping tools having a pistol-like design. However, for the embodiments disclosed in these patents, the crimped work piece is introduced transverse to the muzzle of the pistol-like tool.

U.S. Pat. No. 4,720,911 relates to a tool with a design similar to a tool for rivets. Such tool does not produce a crimping force biasing a work piece in radial direction but produces an axial compression force.

Further prior art is known from German Patents Nos. DE 101 40 270 B4 and DE 42 41 971 C1, and Swiss Patent No. CH 402 099 corresponding to U.S. Pat. No. 3,156,139 and U.S. Pat. No 3,126,750.

SUMMARY OF THE INVENTION

It is an object of the present invention to provide a crimping tool for crimping a connecting element, wherein the orientation or relative position of the hand levers, the crimping jaws and the connecting element or nest might be different from the relative positions and/or orientations of tools known from the above prior art.

It is a further object of the invention to provide an improved access to the crimping tool in particular working fields.

Still a further object of the invention is to provide an adapted transfer or transmission mechanism for the manually applied activation forces to the the crimping jaws.

Furthermore, the present invention has the object to increase the potential of modifying the design of a housing of the tool and/or the activation characteristics of the tool.

The present invention is related with the finding that for the variants a) and b) known from the prior art the options for modifying the relative position and orientation of the hand of the user to the end of a cable, tube, conduit or connecting element is limited. One aim of the present invention is to facilitate new designs and relative positions and orientations between the hand of the user and the connecting element in the crimping tool.

The present invention suggests arranging the hand levers in one plane. Such plane also comprises the longitudinal axis of the connecting element. Whereas such feature is also known from crimping tools according to variant b), according to the invention the two hand levers are located in one and the same half-plane of the aforementioned plane wherein such half-plane is limited by the longitudinal axis. Such design builds a new relative position and orientation for the connecting element and the hand levers with an increased potential for the activation by the user. It is possible that for the inventive design the inventive tool might be used also in crowded assembly spaces. For the inventive design, the orientation of the two hand levers in the mentioned half-plane might vary, wherein the two hand levers or one of the hand levers might have an orientation with an acute angle, a right angle or an obtuse angle with respect to the longitudinal axis.

Furthermore, according to the invention in the force flow between the hand levers and the crimping jaw a transfer or transmission unit (in the following also named "base transmission unit") changes a translational activation into a rotational activation.

For the prior art described above, usually both hand levers are pivotably linked with a housing of the crimping tool. Instead, according to the invention, one hand lever is fixedly linked with the housing of the crimping tool. The other hand lever is moveably or pivotably linked with the housing of the crimping tool. This design provides a simple construction of the crimping tool. Whereas in case of both hand levers being moveable a third element is necessary for bearing the movable hand levers, according to the invention one hand lever which is fixedly linked with the housing or which builds an integral part of the housing might directly be used for bearing or guiding the movable hand lever. It has also been observed that a rigid hand lever facilitates the manipulation of the crimping tool. The reason for such facilitation is that the rigid hand lever builds a fix point during the crimping process having a position and orientation that does not change throughout the crimping process.

According to another embodiment, the inventive crimping tool comprises an outer shape building in a first approximation a kind of pistol. Here, the crimping jaws might be located in the region of a muzzle of the pistol, wherein a nest for the contacting element built by the crimping jaws has an orientation directed coaxial to the muzzle of the pistol. For such design, also a user not familiar with the use of the pistol-like crimping tool intuitively uses the tool by introducing the connecting element into the muzzle of the pistol. For such embodiment, the hand lever fixedly linked with the housing is built by the handle or grip of the pistol, whereas the hand lever movably linked with the housing builds the trigger of the pistol. It is possible that such trigger has a slightly or significantly increased length when compared with the trigger of a pistol. The movable hand lever might be moved along a translational or rotational degree of freedom.

Another embodiment of the invention concentrates on the shape and the forming process and the forces applied by the crimping jaws. Such embodiment relies on the finding that the use of only two crimping jaws might have the disadvantage of a non-uniform force distribution and/or irregularities or undue limitations of the contour formed into the connecting element. In particular, a crimping process basing on only two crimping jaws might be insufficient when crimping a crimping contour having more than four corners or a complex contour. For the known crimping pliers according to the prior art as listed for variant b) the used transfer or transmission unit necessarily limits the number of the activated crimping jaws to two. Here, the invention suggests using at least three crimping jaws, in particular four crimping jaws. The at least three crimping jaws are movable in radial inner direction versus the longitudinal axis of the connecting element by manual activation of the hand levers. The crimping jaws might be built and operated separately or might have degrees of freedom coupled by the transfer or transmission mechanism.

Another embodiment of the invention relates to the transfer or transmission mechanism interposed between the hand levers and the crimping jaws:

According to one embodiment for the transfer or transmission mechanism in the force flow between the hand levers and the crimping jaws, a pivoting or rotational activation is transformed into a translational activation by means of an additional transmission unit. Such rotational activation might be caused by a relative movement or rotation of the two hand levers. Besides the transformation of the rotational activation into a translational activation, the additional transmission unit might change the direction of the activation. The angle between the pivoting axis of the pivoting activation and the axis of the translational activation depends on the design of the transfer or transmission unit.

For another embodiment of the invention, the additional transmission unit might be built with a pivotable cam. Such cam might be directly linked with the hand lever so that a relative movement of the hand levers correlates with a movement of the cam. It is also possible that the cam is rigidly fixed at the hand lever or linked with the hand lever via another transmission unit having a distinct or variable transmission ratio. A cam follower guided in a translational direction abuts the pivotable cam. It is also possible that the cam follower is pressed by a spring against the cam. Accordingly, the cam follower follows a translational path for a distance that depends on the pivoting angle of the cam. The relation between the translational movement and the pivoting movement might be determined by the contour of the cam so that depending on the needs any linear or non-linear dependency might be given. Furthermore, the distance of the contour of the cam from the pivoting axis of the cam defines the lever arm for transferring a torsional moment acting upon the cam to an axial force of the cam follower.

According to one embodiment of the invention, it is possible that by use of the base transmission unit the translational activation of the cam follower produced by the additional transmission unit or of an element coupled with the cam follower is retransferred into a pivoting movement, wherein the pivoting axis for such pivoting activation differs from the pivoting axis of the cam. The pivoting axes of the cam and the output of the additional transmission unit might build an angle of 90°.

For a modification of the crimping tool according to the invention, the base transfer or transmission unit is built with a rotatable drive element. Such drive element according to the invention comprises a guiding groove having an angle of inclination with respect to the longitudinal axis. The translational activation resulting from the additional transmission unit is coupled with a transfer element having a translational degree of freedom. The transfer element itself or at least one pin held by the transfer element is slidably housed in the guiding groove of the drive element. A translational displacement of the transfer element results in a movement of the transfer element and the pin along the guiding groove. Due to the angle of inclination of the guiding groove with respect to the longitudinal axis, such linear movement of the transfer element results in a rotation of the drive element. The relation between the translational displacement of the transfer element and the rotational activation of the drive element is determined by the contour of the guiding groove, in particular the angle of inclination of the guiding groove with respect to the longitudinal axis. In case of the guiding groove having regions with an orientation parallel to the longitudinal axis, the movement of the transfer element in these regions does not result in a rotation of the drive element. With an increase of the inclination angle of the guiding groove with respect to the longitudinal axis the transmission ratio between the translational activation and the rotational activation is increased. The guiding groove might have any contour, wherein it is possible that at least in the region of the guiding groove there is some play or there is no play between the transfer element and the guiding groove. It is also possible that the longitudinal axis of the guiding groove is at least partially straight or curved.

Furthermore, the crimping tool might have another transfer or transmission unit (in the following also named "further transmission unit") interposed in the force flow between the hand levers and the crimping jaws. The further transmission unit converts a rotational activation (e.g. of the aforementioned drive element) into an activation of the crimping jaws in radial inner direction. According to one embodiment such further transmission unit comprises joints for pivotably linking the crimping jaws at the housing with pivoting axes parallel having an orientation parallel to the longitudinal axis. For pivoting the crimping jaws around the pivoting axes a coupling between the drive element and the crimping jaws is provided. Such coupling is located eccentrically to the pivoting axis. Due to the coupling a rotational activation and movement of the drive elements results in a pivoting movement of the crimping jaws around the pivoting axes.

Any "transmission or transfer unit" in the sense of the present invention might be any unit suitable for providing at least one of the following features:

- gearing up or gearing down the activating movement, activating force or activation moment,
- transferring the activating movement or activating force or activating moment from one place to another,
- changing the direction of the activating movement, activating force or activating moment,
- changing a force to a moment or a translational movement to a rotational movement (or vice versa).

Whereas any type of known transfer or transmission unit might be used, some possible examples of such transfer or transmission units are or comprise the following embodiments:

- meshing gear wheels having a cylindrical or spur gear, a worm wheel or a bevel gear,
- a spindle drive or a bendix drive pinion,
- a planetary gear,
- a cam mechanism,
- a link with a plurality of joints as a four-bar mechanism or a prismatic joint or rectilinear sliding pair.

It might lead to advantages using a transfer or transmission unit having a gear ratio increasing the forces or moments applied by the users. According to the invention, it is also possible that the base transmission unit, the additional transmission unit and the further transmission unit are used cumulatively.

For a more compact but also efficient embodiment, the pivoting axis for the crimping jaws are supported or determined by a sleeve fixed in the housing. Such sleeve might comprise the aforementioned guiding groove. The guiding groove is at least in one part inclined with respect to the longitudinal plane both against the longitudinal axis and the circumferential direction of the sleeve. The drive element is located inside the sleeve and rotatable with respect to the longitudinal axis of the sleeve. The transfer element is built with at least one pinion extending in radial outward direction into the guiding groove. Locating the drive element within the sleeve leads to a compact but efficient transmission unit.

Furthermore, the invention suggests interposing a spring element into the force flow between the hand levers and the crimping jaws. Such spring element might be used for influencing the characteristics of the activation movement and the activation force.

A return spring might be provided with one base of the return spring linked with the housing and the other base of the return spring linked with an element moved throughout the activation of the pliers. Accordingly, a manual activation of the hand levers leads to an increase of the bias of the return spring. The return spring returns the pliers into a starting position at the end of a crimping step or of the whole crimping process so that it is not necessary to manually return the hand levers and the crimping jaws into the starting position.

According to another embodiment of the inventive crimping tool a locking device is integrated into the crimping tool. Such locking device comprises a plurality of securing positions, locking or resting positions over the crimping movement. The locking device secures a crimping step reached throughout the crimping process against a reverse movement of the crimping jaws for a decrease of the force manually applied upon the hand levers.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
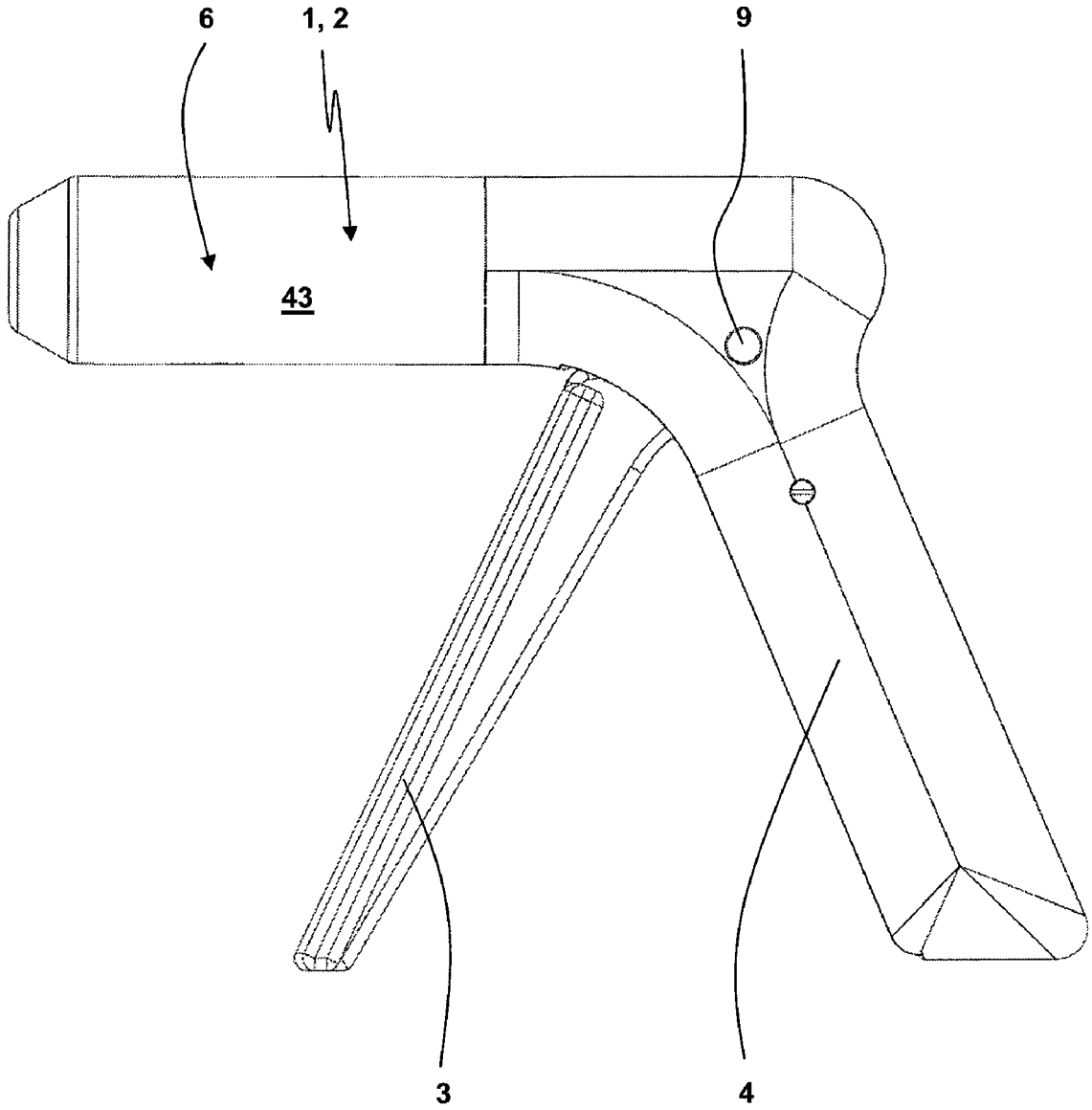
FIG. 1 is a side view of a crimping tool according to the invention.

Referring now in greater detail to the drawings, FIGS. 1 to 15 show a crimping tool 1, here crimping pliers 2 or parts of the same. In the crimping pliers 2 a force manually applied upon hand levers 3, 4 is transferred via a transfer or transmission mechanism 7 to the crimping jaws 5. The hand levers 3 are movable relative to a housing 6 of the crimping pliers. Hand lever 4 is fixed at the housing 6 or integral part of the same. The hand levers 3, 4 can be gripped by one single hand of a user. The hand lever 3 is pivotable with respect to the hand lever 4 or the housing 6 around a pivoting axis 8. The pivoting axis 8 has an orientation perpendicular to the drawing plane according to FIG. 2. For the shown embodiment the pivoting axis 8 is provided by a bearing bolt 9 extending through the hand lever 4 and being pivotably linked on both sides of the hand lever 3 in coaxial bores of the housing 6. On the side of the pivoting axis 8 and the bearing bolt 9 opposite to the hand lever 3 there is a lever, protrusion or cam 10 which is rigidly linked with the hand lever 3. It is possible that hand lever 3, bearing bolt 9 and cam 10 are integrally built as one single activation element 11.

The cam 10 builds remote from the pivoting axis 8 an activation contact 12 with a cam follower 13 which is movable along the longitudinal axis 14-14 with a translational degree of freedom. In the shown embodiment, the cam follower 13 is disc-like shaped. A rod 16 extends along the longitudinal axis 14-14 through the center of the cam follower 13 wherein there is no coupling between the cam follower 13 and the rod 16 in longitudinal direction. The rod 16 comprises a circular cross-section. Furthermore, in an end region opposite to the crimping jaws 5 the rod 16 is guided in a bore 17 of housing 6. The hand lever 3 comprises a region being angled, cranked or offset in the direction of the pivoting axis 8. The cranked region builds an angle of approximately 90° to the main plane of extension of the cam 10. The longitudinal axis of the hand lever 3 extends (at least in the starting state shown in FIG. 2) approximately through the activation contact 12 between cam 10 and cam follower 13. The relation of the length of the hand lever 3 to the pivoting axis 8 and the distance of the activation contact 12 to the pivoting axis is between approximately 3 to 9, in particular between 4 to 8 or 5 to 6.

For the shown embodiment, the cam follower 13 is built by a ring-shaped disc having a central through hole. The through hole is used for guiding the cam follower 13 against the rod 16 extending through the through hole. From the cam follower 13 the force is transferred along the longitudinal axis 14-14 via a spring element 15. For the shown embodiment, the spring element 15 is built as a sleeve 18 made of an elastic material, in particular PE. The sleeve 18 comprises an inner bore. The rod 16 is passed through the inner bore wherein there is a radial play between rod 16 and inner bore for providing a translational degree of freedom along the longitudinal axis 14-14. The base of the spring element 15 opposite to the cam follower 13 abuts a supporting disc 19. The supporting disc 19 also comprises a central through hole radially guiding rod 16 along the longitudinal axis 14-14 but providing a translational degree of freedom.

From the supporting disc 19 the force flow divides on at least one, for the shown embodiment four return springs 20 located at equidistant circumferential positions. The bases of the return springs 20 are supported by or abut the supporting disc 19, whereas the other respective spring bases are in axial direction directly or indirectly fixed at the housing 6. Parallel to the return springs 20 the force flow is transmitted via a transfer element 21. One end region of the transfer element 21 comprises a pocket hole housing the end region of rod 16 providing a translational degree of freedom between transfer element 21 and rod 16 along the longitudinal axis 14-14. The transfer element 21 abuts with a ring-shaped front surface at the supporting disc 19. The transfer element 21 has a translational degree of freedom along the longitudinal axis 14-14 but is blocked against a rotation around the longitudinal axis 14-14. Such blocking might be provided by a suitable guiding element between the transfer element 21 and the housing 6. For another embodiment, the connection between the transfer element 21 and an adjacent element, e.g. the supporting disc 19 and/or the rod 16, might block a rotational degree of freedom, whereas the adjacent element is also fixed against rotation around the longitudinal axis 14-14 against the housing 6.

The transfer element 21 at the end region opposite to the supporting disc 19 comprises two tappets or pins 22 extending transverse to the longitudinal axis 14-14 and being located at opposite positions at the circumference of the transfer element 21.

A drive element 23 (which is shown in detail in FIG. 9) has a cylindrical shape. The drive element 23 comprises a pocket bore 55 at the end region opposite to the crimping jaws 5. In the region of the pocket bore 55 the drive element 23 comprises a guiding groove with a closed guiding contour. The guiding groove 24 in a developed view of the outer surface of the drive element 23 has a straight guiding axis but is inclined both against the longitudinal axis 14-14 and the circumferential direction. The end region of the transfer element 21 comprising the pins 22 extends through the pocket bore of the drive element 23, whereas the pins 22 extend in radial direction through the guiding groove 24. For providing the possibility of an assembly of the transfer element 21 and the drive element 23 it is possible to fix the pins 22 at the transfer element 21 after inserting the transfer element 21 into the pocket hole 55 of the drive element 23. According to one embodiment, the transfer element 21 might comprise a transverse through hole so that it is possible to pass the pins 22 or one single longer pin through the transfer through hole. For a fixation of the pins 22 in the through hole a close fit or interference fit or transition fit might be used.

In the end region of the drive element 23 facing the crimping jaws 5, the front surface comprises four coupling grooves 25. The coupling grooves 25 are located equidistantly in circumferential direction and extend from the longitudinal axis 14-14 in radial direction. The coupling grooves 25 have a closed contour and comprise a bottom of the groove. Due to the fact that the drive element 23 comprises a fixed position in the direction of the longitudinal axis 14-14, a movement of the transfer element 21 along the longitudinal axis 14-14 has the effect that the pins 22 move in the guiding groove 24. Forces acting upon the transfer element 21 in longitudinal direction cause forces in the guiding groove 24 being oriented in circumferential direction of the guiding groove 24. These forces cause a rotation of the drive element 23.

Figure 8:
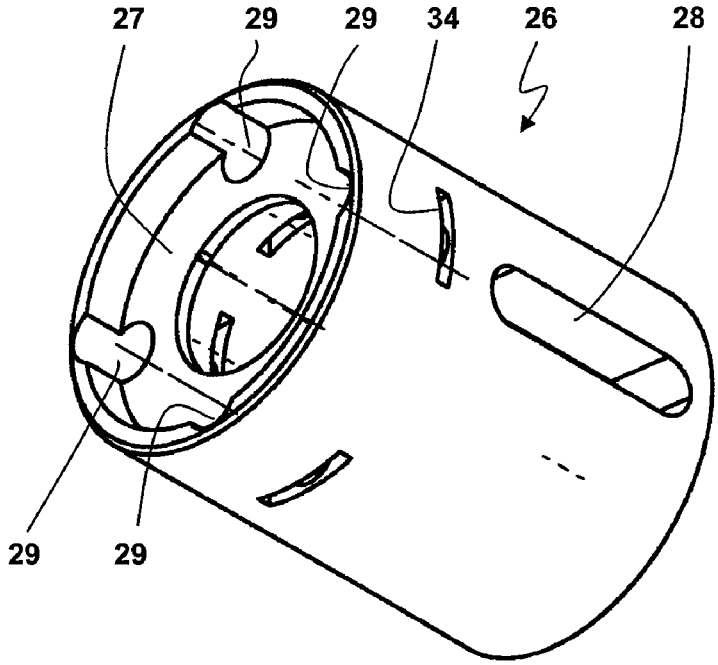
FIG. 8 shows a sleeve for use in a crimping tool according to FIGS. 1 to 7 in a three-dimensional view.
Figure 9:
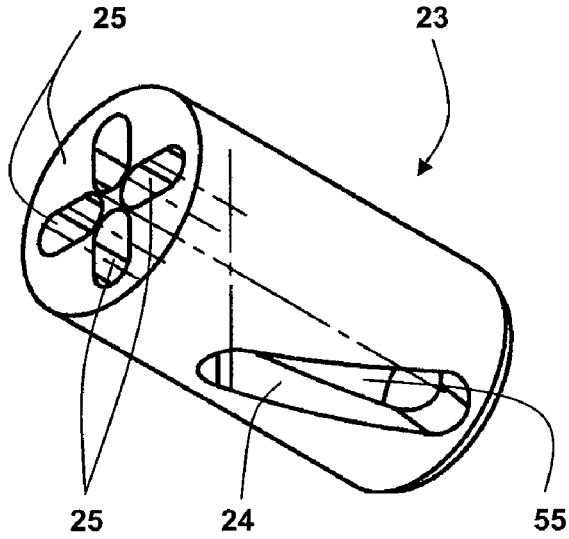
FIG. 9 shows a drive element in three-dimensional view being used in a crimping tool according to FIGS. 1 to 7.

The drive element 23 is housed in a sleeve 26 shown in FIG. 8. The drive element 23 and the sleeve 26 are connected such that the drive element 23 is axially fixed in the sleeve 26 but able to rotate around the longitudinal axis 14-14. The sleeve 26 has—in a first approximation—a hollow cylindrical shape having a ring-shaped inner collar 27. The drive element 23 in the direction of the crimping jaws 5 abuts the collar 27 for fixing its axial position. On the end region of collar 27 opposite to the crimping jaws 5 the sleeve 26 comprises a supporting groove 28 having an orientation parallel to the longitudinal axis 14-14 and having no bottom. In radial outward direction from the drive element 23 the pins 22 extend into the supporting groove 28. The sleeve 26 is fixed against the housing 6. Accordingly, the supporting groove 28 guarantees that the pins 22 and the transfer element 21 are guided along the longitudinal axis 14-14 without a degree of freedom for a rotation around the longitudinal axis 14-14.

Figure 10:
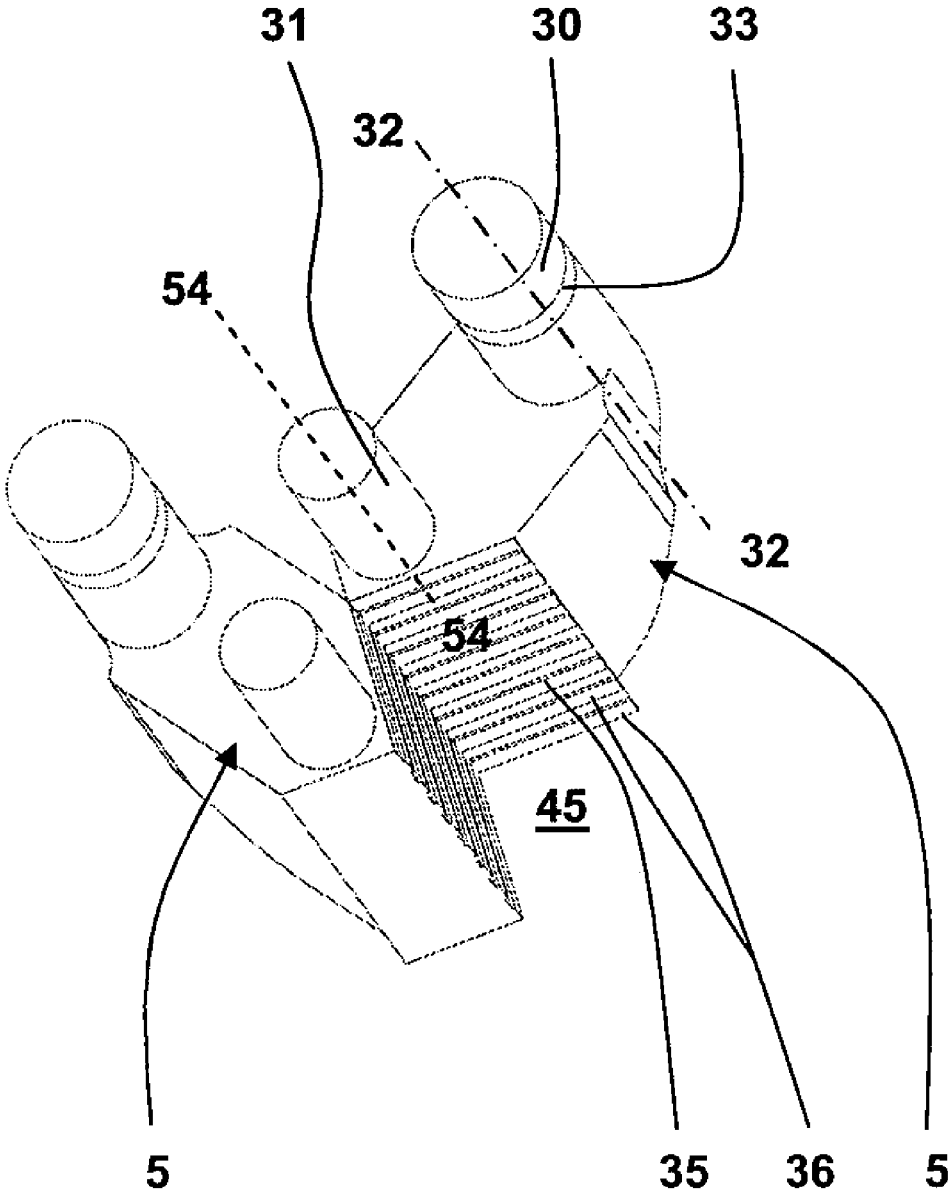
FIG. 10 shows a three-dimensional view of two of four crimping jaws of a crimping tool according to FIGS. 1 to 7.
Figure 11:
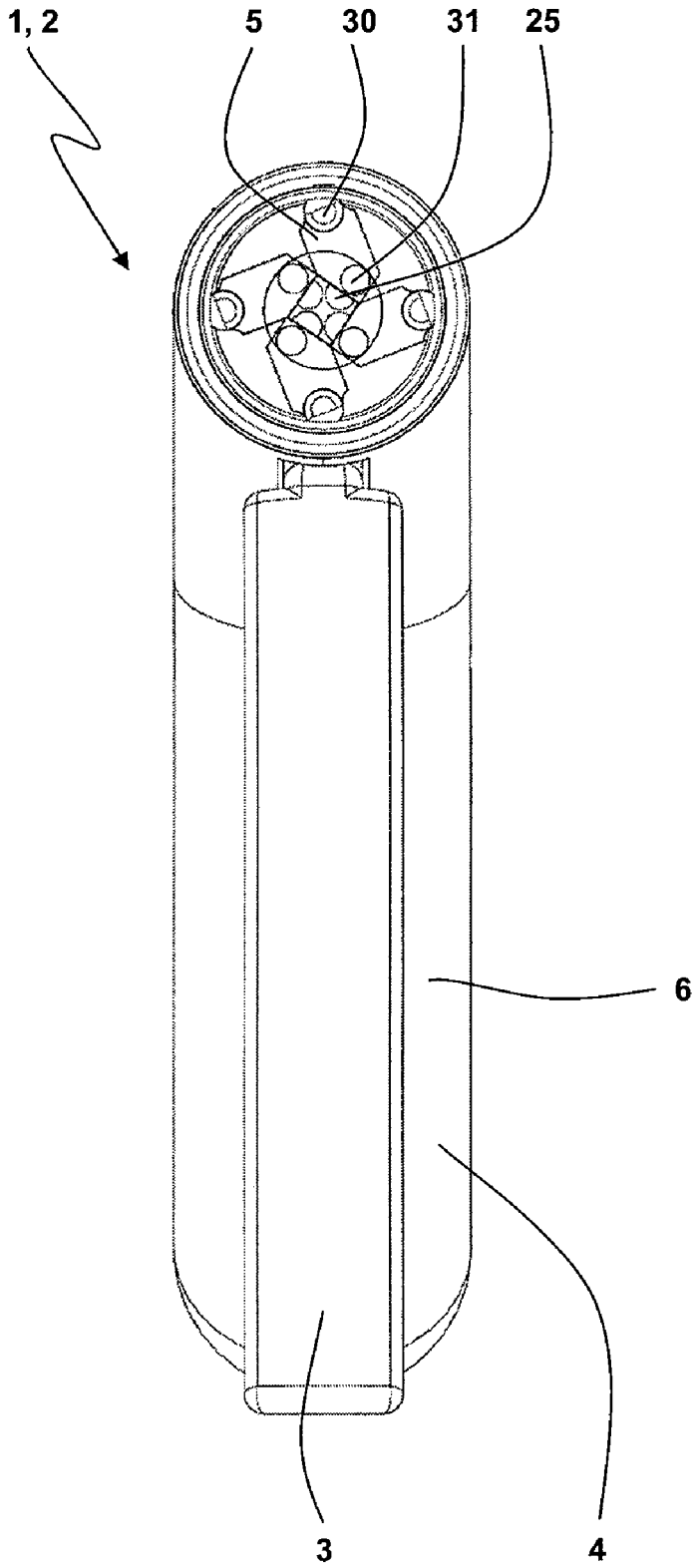
FIG. 11 shows a sectional view XI-XI of the crimping tool according to FIG. 2.
Figure 12:
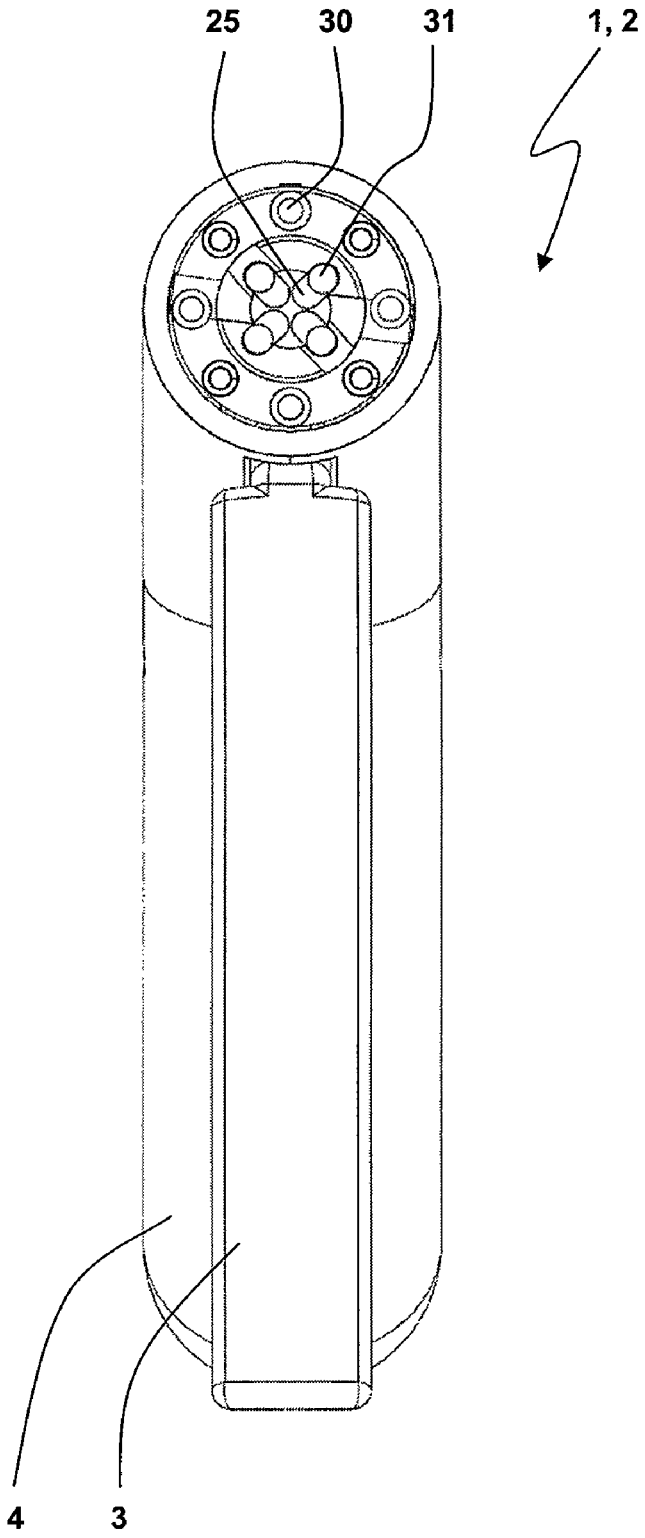
FIG. 12 shows a sectional view XII-XII of the crimping tool according to FIG. 2.

In the end region facing the crimping jaws 5, the sleeve 26 comprises four bearing bores 29 being located equidistantly in circumferential direction. For the shown embodiment, the bearing bores 29 are partially limited by collar 27. FIG. 10 shows—for an opposite viewing direction when compared to FIGS. 8 and 9—two crimping jaws 5. The crimping jaws 5 comprise two cylindrical extensions 30, 31 extending parallel to the longitudinal axis 14-14. The extensions 30 being located further outside in radial direction than the crimping surfaces 35 might be passed into the bores 29 and might be secured in the bores 29 by means of a securing element such that a movement of the crimping jaws 5 along the longitudinal axis 14-14 is not possible whereas a pivoting movement around the pivoting axes 32 is possible around the longitudinal axes of the bores 29 and the longitudinal axes of the extensions 30. For the shown embodiment, the extensions 30 each comprise a circumferential groove 33. Such circumferential groove 33 is aligned with a slit 34 of the sleeve 26 for the extension 30 being introduced into the sleeve 26. A safety or locking plate, a safety pin or a U-shaped safety ring might be introduced into slit 34 and circumferential groove 33 building a positive locking in the direction of the longitudinal axis 14-14 for securing the extension 30 in the sleeve 26.

The extension 31 (which has a smaller distance from the longitudinal axis 14-14 than the extension 30) is housed in a coupling groove 25 of the drive element 23. In case of the drive element 23 not being rotated, the position of the crimping jaw 5 is fixed due to the fact that the sleeve 26 is fixed against the housing. This is also due to the fact that the connection of the extension 30 and the sleeve 26 only leaves a pivoting degree of freedom around the pivoting axis 32-32. However, such pivoting degree of freedom is fixed through the contact of the extension 31 with the limiting surfaces of the supporting groove 28. However, a rotation of the drive element 23 around the longitudinal axis 14-14 has the effect that the coupling groove 25 moves the extension 31 leading to a pivoting movement of the crimping jaw 5 around the pivoting axis 32-32 determined by the extension 30. The dependence of the pivoting angle of the crimping jaw 5 around the pivoting axis 32 on the pivoting angle of the drive element 23 depends on the geometric properties, here the distances of the longitudinal axis 14-14, the longitudinal axis 54-54 of extension 31 and the pivoting axis 32. The pivoting movement of the crimping jaw 5 changes the distance of the longitudinal axis 54-54 of the extension 31 from the longitudinal axis 14-14. For that reason the coupling groove 25 is not built by a simple bore but by a groove having a certain longitudinal extension.

The crimping jaws 5 each comprise crimping surfaces 35 being built by a plurality of crimping discs 36. The crimping discs 36 building the crimping surfaces 35 have a distance that it slightly larger than the thickness of the crimping discs 36. Accordingly, the crimping surface 35 is built with single interrupted contact areas. For adjacent crimping jaws 5, the crimping discs 36 are offset such that the crimping discs 35 of one crimping jaw 5 are able to enter into gaps between crimping discs 36 of an adjacent crimping jaw 5. As a consequence, the crimping discs 36 of adjacent crimping jaws might overlap wherein the degree of the overlap depends on the pivoting movement of the crimping jaws 5 around the pivoting axis 32-32. With a change of the overlap the size of the crimping surface 35 changes. Accordingly, the contour of a connecting element pressed between the crimping jaws 5 and the cross-section of the same changes.

At the end region opposite to the crimping jaws 5 the rod 16 is directly housed in the bores 17 of housing 6. In the end region facing the crimping jaws 5 the rod 16 is indirectly supported in radial direction by the housing 6. For such purpose, it is possible to interpose the supporting disc 19 and/or the transfer element 21, the drive element 23 and the sleeve 26 (without or with play) between the rod 16 and the housing 6. It is possible that the rod 16 has a floating mounting with a degree of freedom along the longitudinal axis 14-14. However, it is also possible that the rod 16 is coupled with or fixed at one of the mentioned elements that has a translational degree of freedom along the longitudinal axis 14-14.

Figure 2:
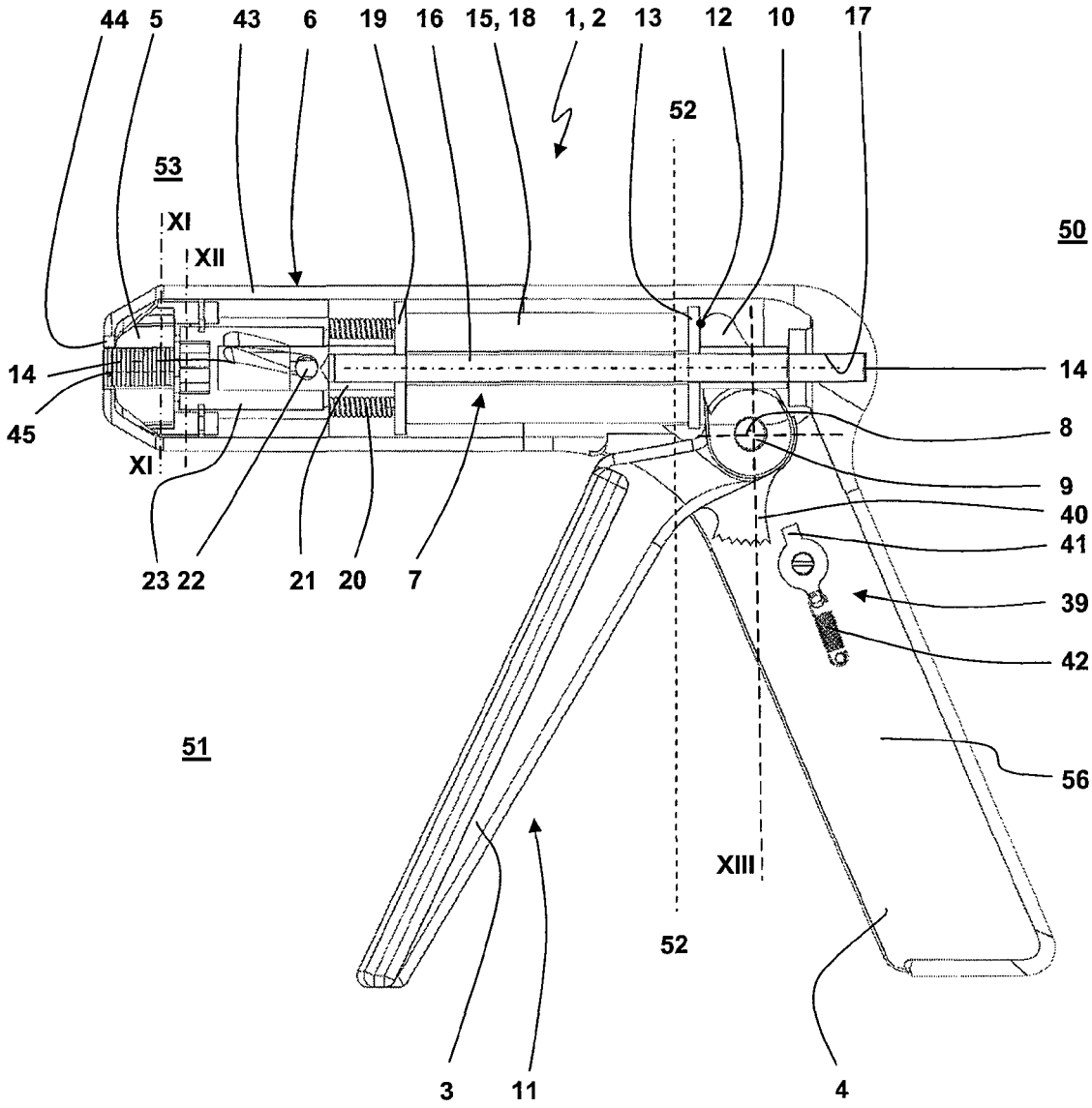
FIG. 2 shows the crimping tool according to FIG. 1 in a longitudinal sectional view in a starting state for opened hand levers and opened crimping jaws.
Figure 3:
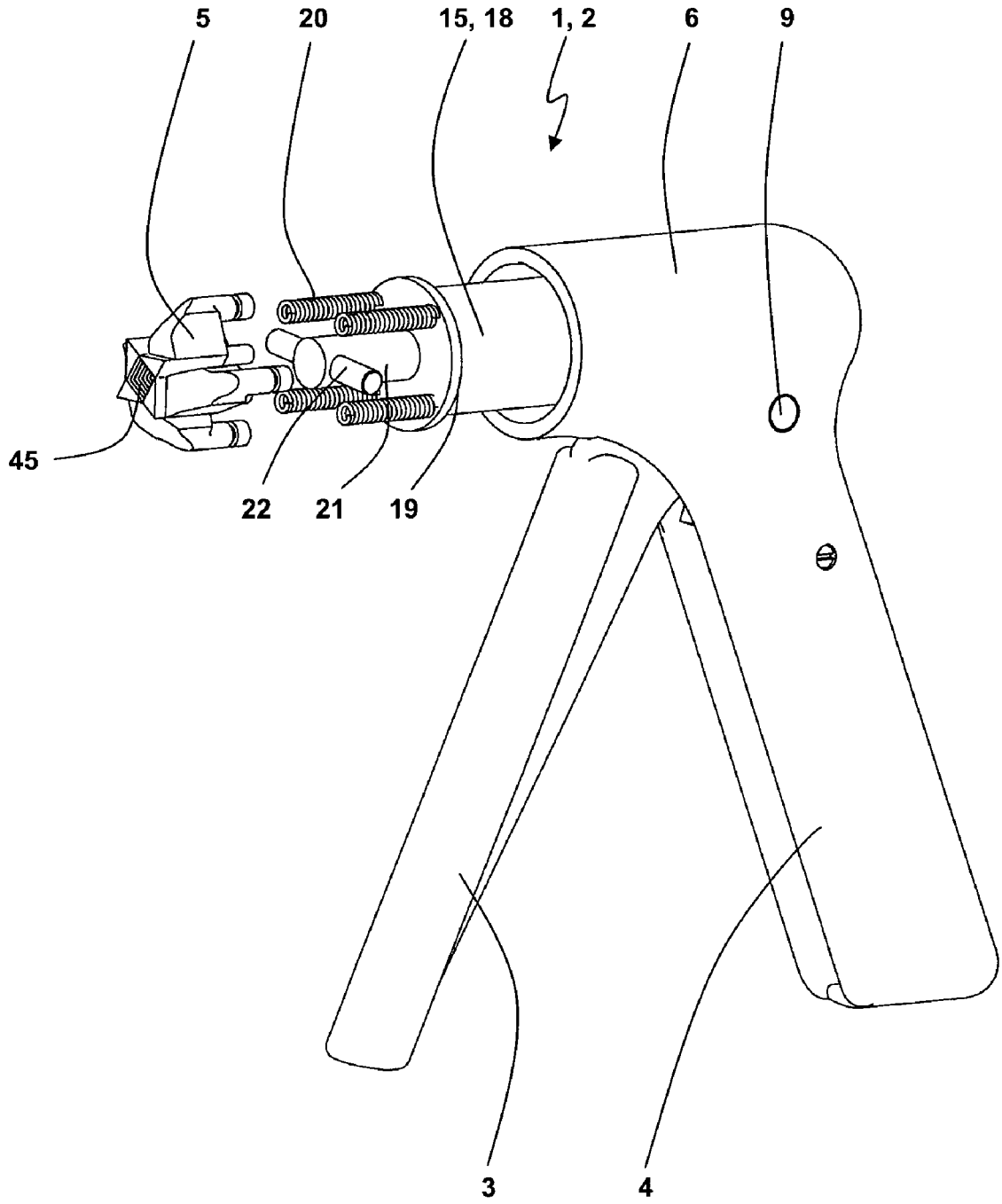
FIG. 3 shows the crimping tool according to FIGS. 1 and 2 in a three-dimensional view in a partially disassembled state.
Figure 4:
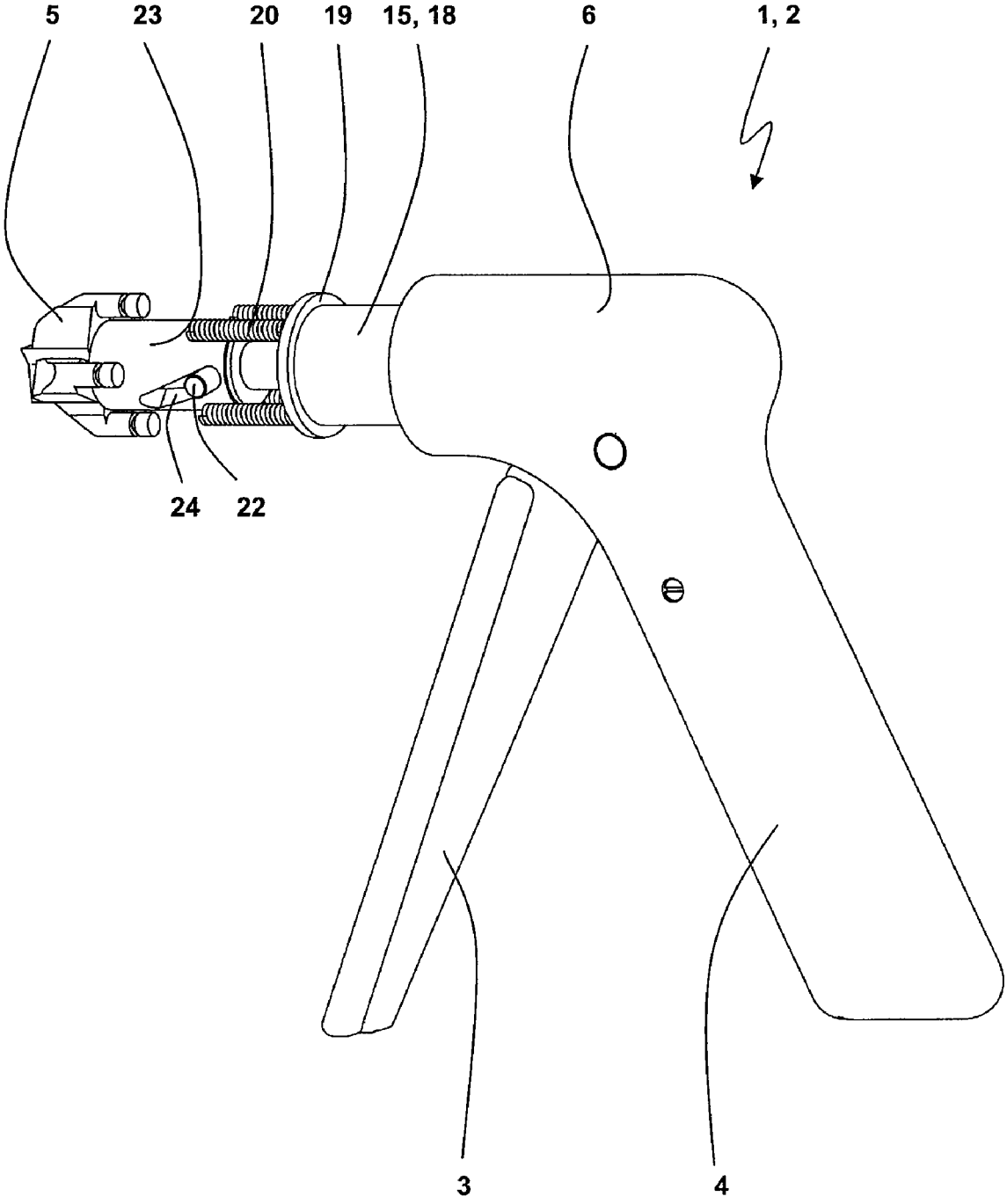
FIG. 4 shows the crimping tool according to FIGS. 1 to 3 in a three-dimensional view in a partially disassembled state.
Figure 5:
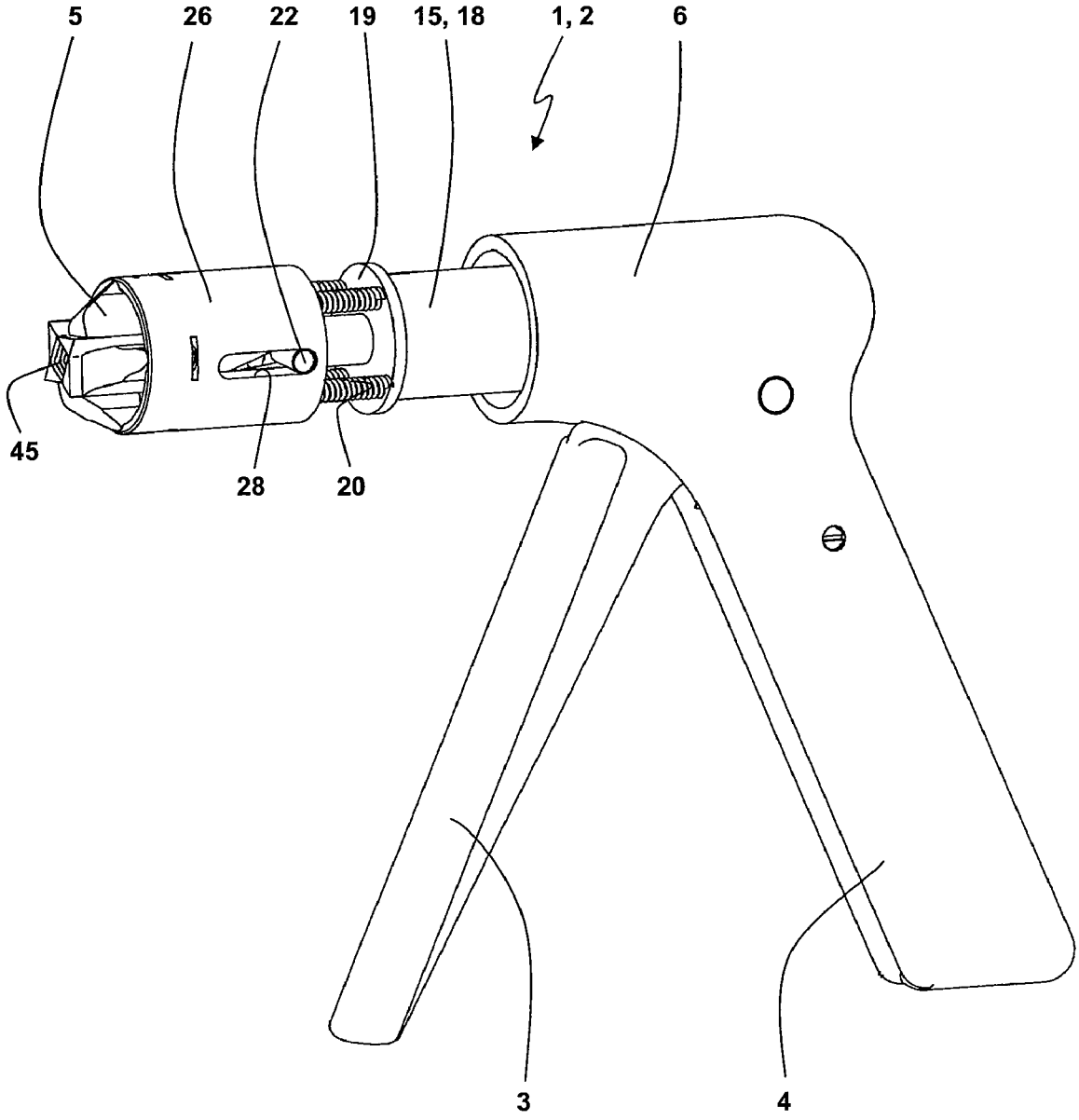
FIG. 5 shows the crimping tool according to FIGS. 1 to 4 in a three-dimensional view in a partially disassembled state.
Figure 6:
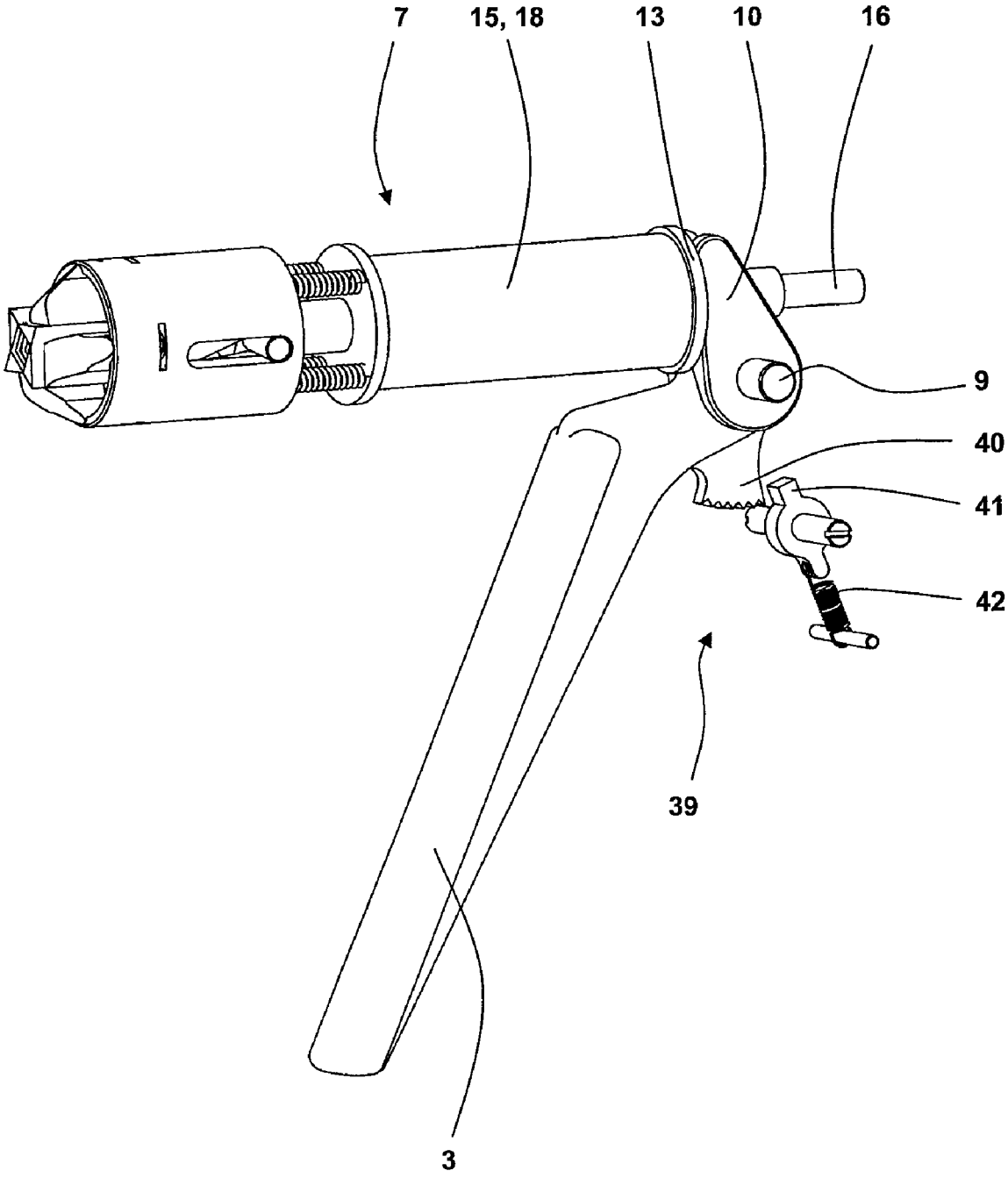
FIG. 6 shows the transfer or transmission mechanism of the crimping tool according to FIGS. 1 to 5 in a three-dimensional view.
Figure 7:
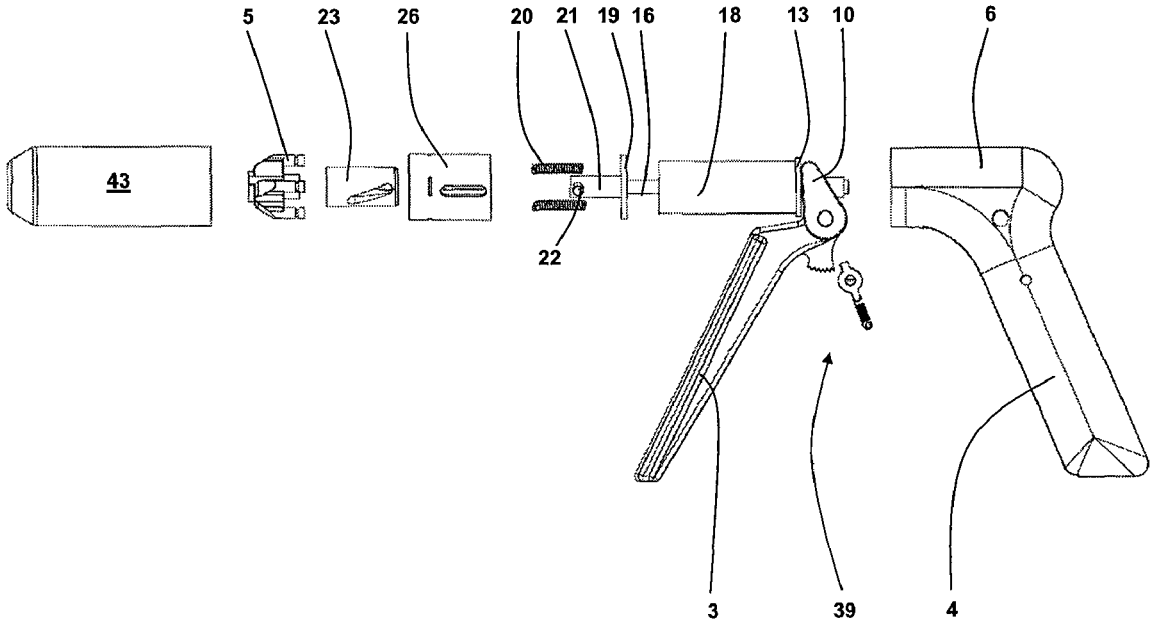
FIG. 7 shows the crimping tool according to FIGS. 1 to 6 in an explosional view.

For the shown embodiment, the force flow in the crimping pliers 12 is as follows:

Upon manual application of a force upon the hand levers 3, 4 hand lever 3 is rotated in counterclockwise direction in FIG. 2 around the pivoting axis 8. As a consequence, also the cam 10 rotates in counterclockwise direction in FIG. 2. The activation contact 12 is moved along the longitudinal axis 14-14 versus the crimping jaws 5. The force manually applied upon the hand levers 3, 4 is transferred according to the geometric properties, so according to the distance of the activation point of the hand of the user from the pivoting axis and the distance of the activation contact 12 from the pivoting axis 8. The force in the activation contact 12 is transferred via the spring element 15 to the supporting disc 19. At the supporting disc 19 the force is divided to the return spring 20 and the transfer element 21. From the transfer element 21 the translational movement along the longitudinal axis 14-14 is transferred to a rotational movement of the drive element 23. This is done by the aforementioned coupling between the pins 22 and the guiding grooves 24. The transfer ratio depends on the angle of inclination of the guiding groove 24. Due to the coupling of the coupling grooves 25 with the extensions 31, a rotation of the drive element 23 leads to a pivoting movement of the crimping jaws 5. The pivoting movement of the crimping jaws 5 is such that the distance of the crimping surfaces 35 from the longitudinal axis 14-14 is decreased. Simultaneously a crimping force is produced acting in the radial inner direction. The transfer ratio of the rotating movement of the drive element 23 to the pivoting movement of the crimping jaws 5 and in the end the radial crimping force of the crimping surfaces 35 is determined by the distances between the longitudinal axis 14-14, the longitudinal axis 54-54 of the extensions 31 and the pivoting axis 32-32.

For the shown embodiment, the following optional features might be provided:

In case of using a spring element 15 having a large (or theoretically unlimited) stiffness, a fixed kinematic relationship is given between the pivoting movement of the hand lever 3 around the pivoting axis 8 and the pivoting angles of the crimping jaws 5 around the pivoting axes 32-32. Instead, in case of using a spring element 15 having a very small (or theoretically a zero-) stiffness, it is possible to pivot the hand lever 3 without pivoting the crimping jaws 5 and without producing a radial crimping force of the crimping jaws 5 at a connecting element. For any stiffness chosen between the above extreme values, different activations of the transfer of transmission mechanism 7, so different crimping forces at the crimping jaws 5, lead to different deformations of the spring element 15 leading to a change of the distance of the supporting disc 19 and the cam follower 13. Accordingly, the choice of the stiffness of the spring element 15 determines the activation characteristic of the crimping pliers 2. It is possible to use spring elements 15 having any available spring characteristic, e.g. with a constant spring stiffness or a spring stiffness being dependent on the force or the deformation. Furthermore, it is possible to influence the activation characteristic, in particular the transmission ratio between a force applied upon the hand levers and the crimping force, by designing the outer contour of cam 10, guiding groove 24 and/or the coupling groove 25.

The guiding rod 16 is used for guiding movable components of the pliers 2 along the longitudinal axis 14-14. However, it is also possible that another guidance is used for the elements of the transfer or transmission mechanism 7. It is also possible that the rod 16 is fixedly coupled with the cam follower 13 and directly activates with its front surface the drive element 23. It is also possible that the rod 16 is integrally built with the drive element 23. In such case, it is not necessary to use the spring element 15 or sleeve 18 and the supporting disc 19.

The force in the return spring 20 increases with the closing movement of the hand levers 3, 4. When finishing the crimping process and removing the manual force acting upon the hand levers 3, 4, the return spring(s) 20 return the transfer or transmission mechanism 7 into the state shown in FIG. 2.

Figure 13:
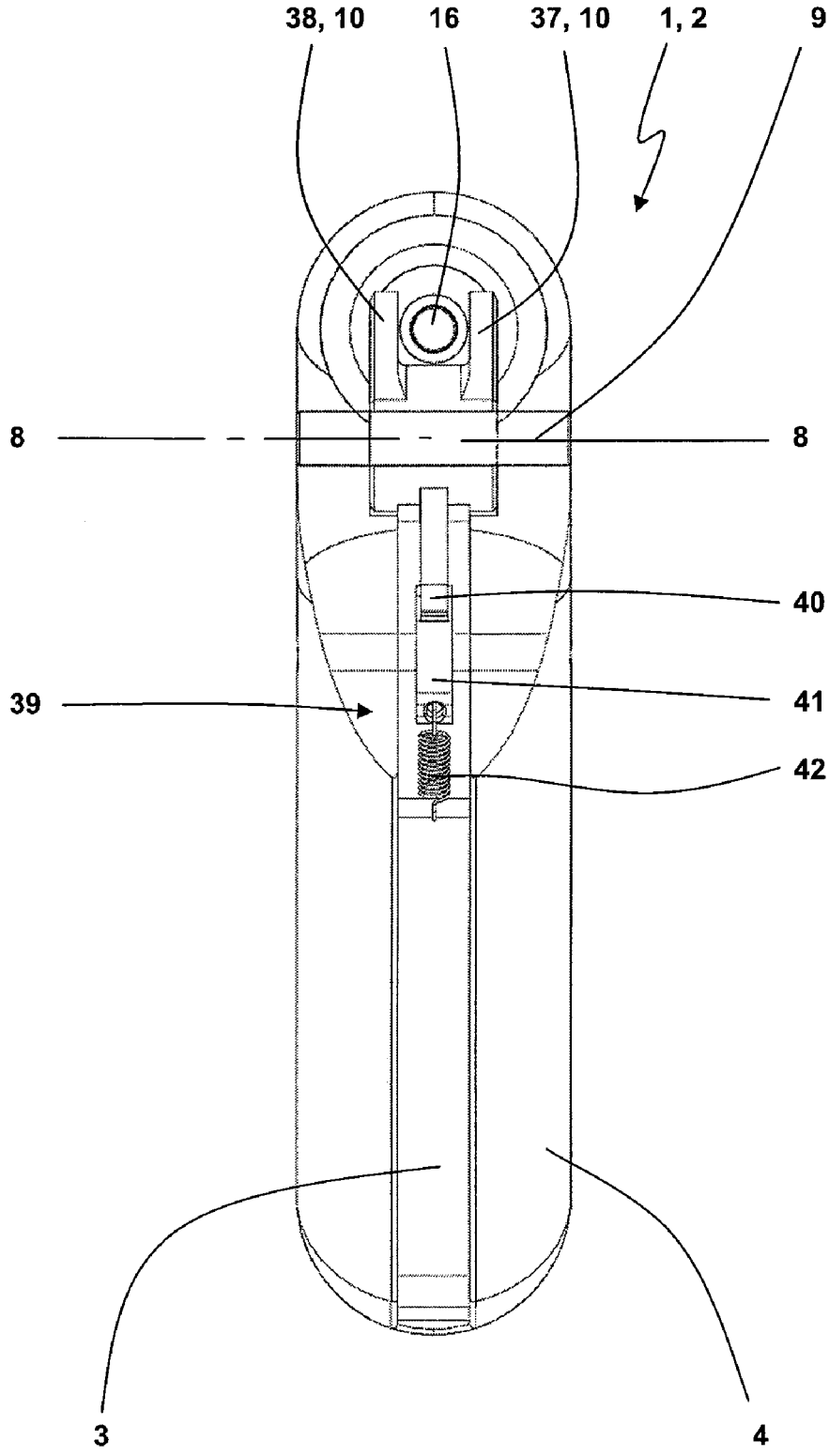
FIG. 13 shows a sectional view XIII-XIII of the crimping tool according to FIG. 2.
Figure 14:
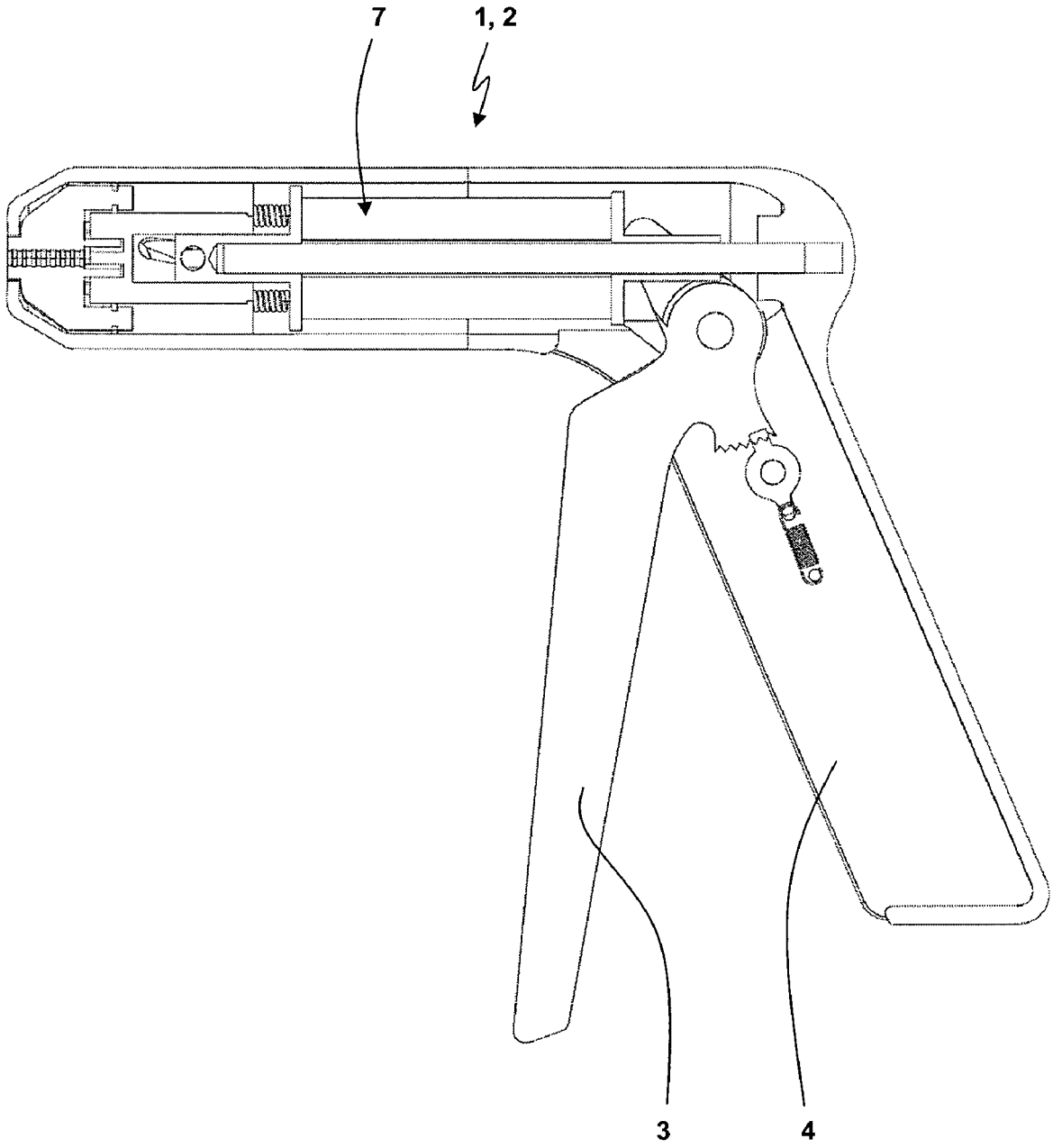
FIG. 14 shows the crimping tool according to FIG. 1 in a longitudinal sectional view for partially closed hand levers and crimping jaws.
Figure 15:
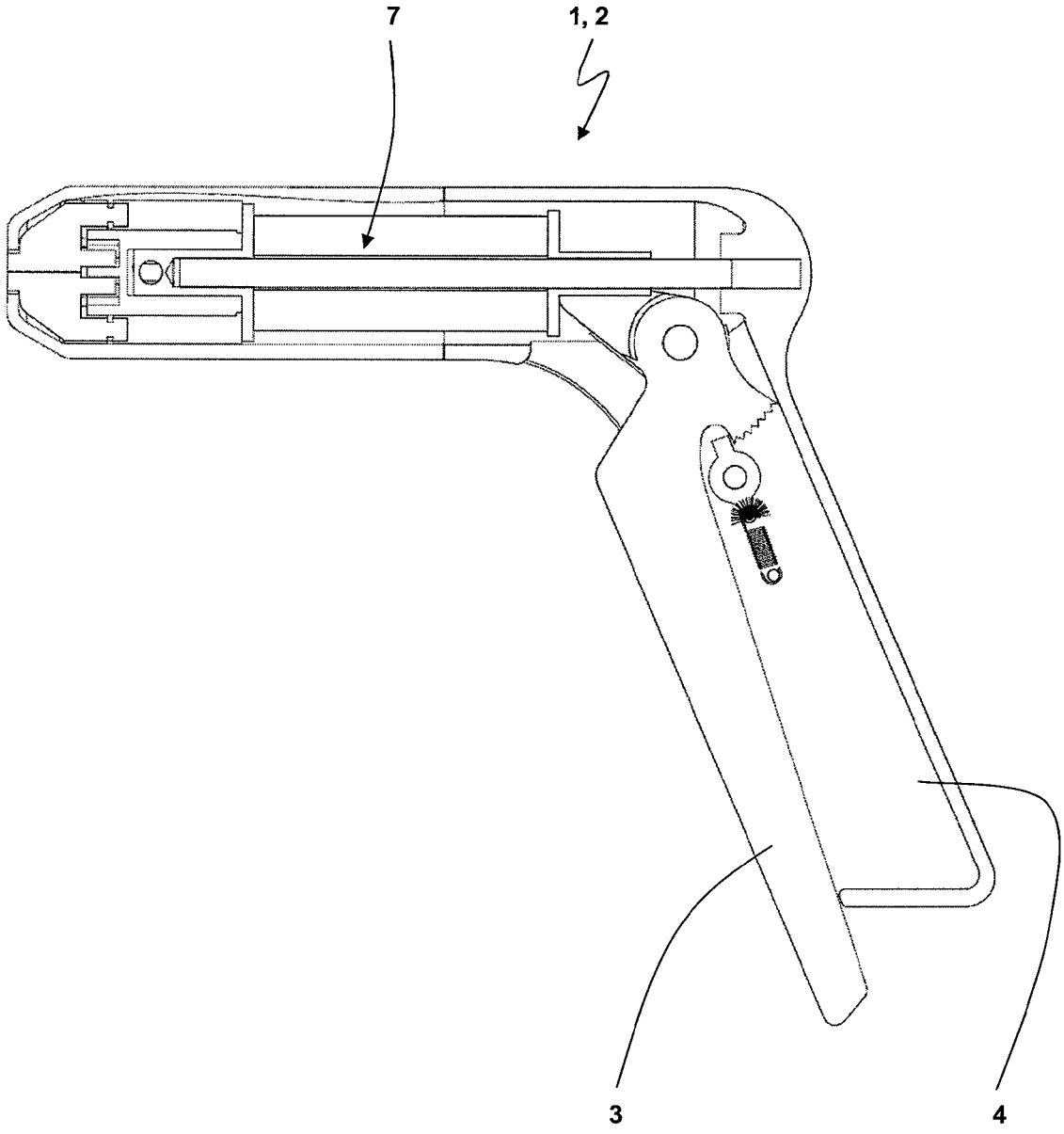
FIG. 15 shows the crimping tool according to FIG. 1 in a longitudinal sectional view for closed hand levers and crimping jaws.

The cross-sectional view of FIG. 13 shows the cam 10 being built with two cam discs 37, 38 being parallel to each other and rigidly coupled with each other. These cam discs 37, 38 contact the cam follower 13. The rod 16 extends through an intermediate space built between the cam discs 37, 38.

Furthermore, there is the option that the crimping pliers 2 comprise a locking unit 39 which is greater detail is described in DE 197 13 580, see corresponding U.S. Pat. No. 5,913,933 and other patents or patent applications of the applicant. For building the locking unit, the activation element 11 comprises a toothed segment 40 which might be located adjacent to the pivoting axis 8 concentrically to the pivoting axis 8. The toothed segment 40 is engaged by a locking element 41 which is forced against the toothed segment 40 by means of a spring 42. The toothed segment 40 and locking element 41 have a contour such that starting from the starting state of the crimping pliers 2 during the crimping process the locking element 41 moves from one tooth to the next along the outer circumference of the toothed segment 40. By means of the locking element 41 a reverse movement of the hand levers 3, 4 with a decrease of the force applied by the hand of the user away from each other is avoided. In case of the hand levers 3, 4 reaching the completely closed state, the locking element 41 leaves the toothed region of the outer contour of the toothed segment 40 and pivots around its pivoting axis so that another contact surface of the locking element 41 comes into contact with the toothed segment 40. Such contact allows a pivoting movement of the hand levers 3, 4 away from each other. When reaching the completely opened state of the hand levers 3, 4, the locking element 41 again leaves the toothed region of the outer contour of the toothed element 40, snaps to the opposite position by a pivoting movement so that the locking element again might be used at a locking unit 39 during the next crimping process. The locking unit 39 is used for securing an intermediate crimping stage against a reverse movement.

For the shown embodiment, the crimping pliers 2 are in a first approximation built with a design similar to a pistol, wherein the handle of the pistol is built by hand lever 4 and the barrel of the pistol contains the transfer or transmission mechanism 7. Handle and barrel of the pistol have approximately the same lengths. However, depending on the desired geometries and the transmission ratios the length of the pistol might be longer or shorter independent on the used type of transfer or transmission mechanism 7. The movable hand lever 3 is built by the trigger of the pistol, wherein hand lever 3 has approximately the same length as the hand lever 4. The hand lever 4 and the barrel containing the transfer or transmission mechanism 7 build an angle of approximately 90° to 130°, in particular 100° to 120°, whereas the hand levers 3, 4 in the starting state shown in FIG. 1 build an angle of approximately 45° to 75°, in particular 50° to 70°. The middle axis 52-52 in the middle between the hand levers 3, 4 has approximately an orientation transverse to the longitudinal axis 14-14.

The housing 6 might be built as a hollow housing with a small wall thickness and might be manufactured by injection molding of a metal material or plastic material. Furthermore, it is possible that the housing 6 is built with two half-shells with a separation plane parallel to the drawing plane of FIG. 1. For the shown embodiment, the housing 6 in its front region is built with a hollow cylindrical sleeve with a reduced diameter at the front opening 44 building a muzzle of the pistol. The muzzle is used for introducing the connecting element into a nest 45 built and limited by the crimping surfaces 35. The two half-shells can be manufactured in an injection molding process, wherein the relevant parts of the bore 17 for the rod 16 and bores for the bearing bolts might be formed integrally by the half-shells. For the shown embodiment, the half-shells in the region of the separation plane of the hand lever 4 build an opening designed and arranged for receiving the hand lever 3 at the end of the crimping process.

Figure 16:
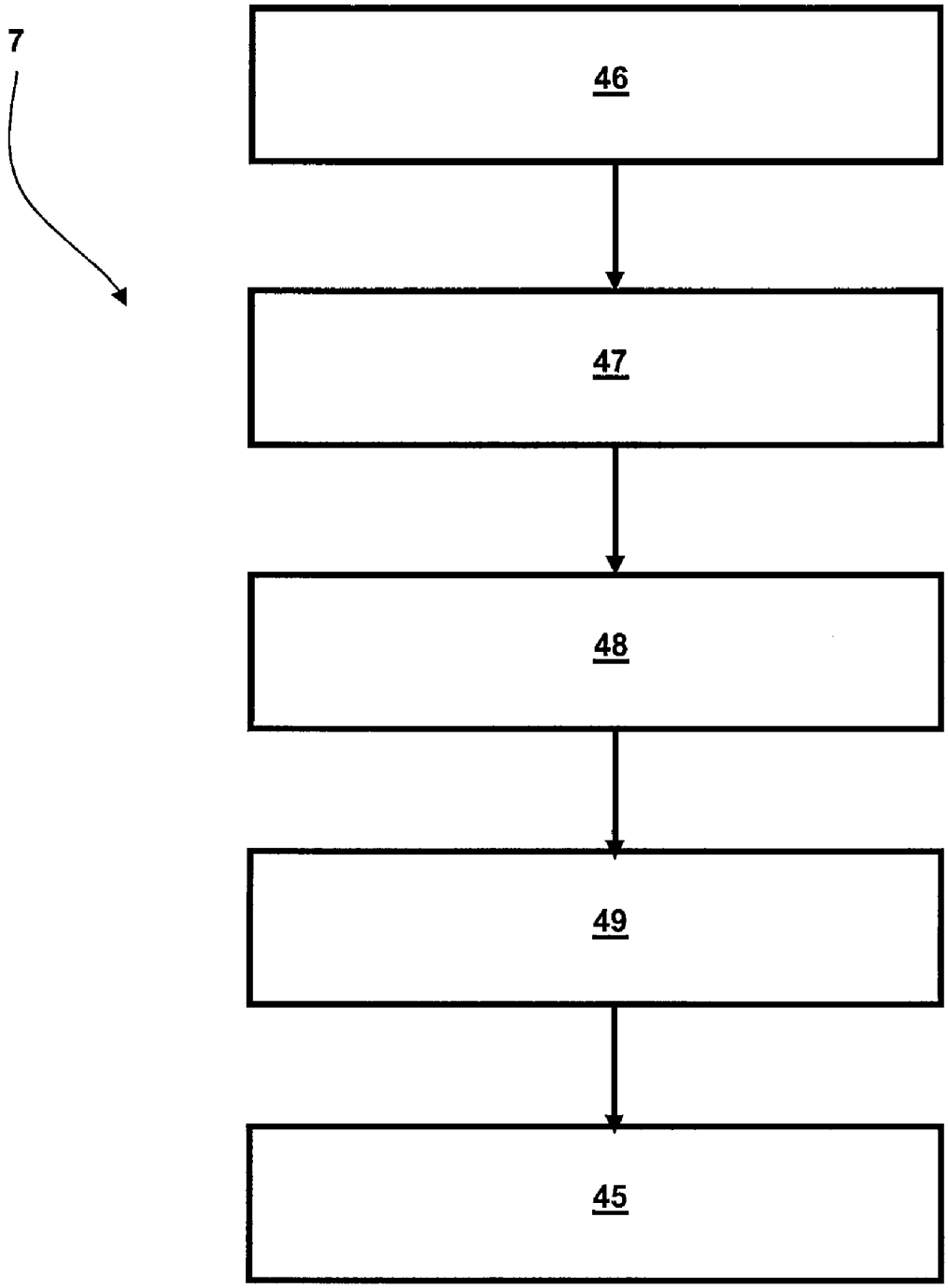
FIG. 16 shows a schematic block diagram for the transfer or transmission mechanism for the movement and the forces between the hand levers and the crimping jaws and a plurality of involved transmission units.

FIG. 16 shows a schematic diagram of a transfer or transmission mechanism 7 of inventive pliers:

Via the activation unit 46 an activation force and/or an activation movement is produced. The activation force or activation movement is transferred as an input to the additional transmission unit 47. For the shown embodiment of the crimping pliers 2, the additional transmission unit 47 is built with the activation element 11, cam 10 and cam follower 13. The additional transmission unit 47 transfers or converts a relative movement of the hand levers 3, 4 (for the shown embodiment a pivoting movement of the hand lever 3 relative to the housing 6) into a translational movement (for the shown embodiment of the cam follower 13 along the longitudinal axis 14-14). With or without the interposition of a spring element 15, the changed activation force or activation movement at the output of the additional transmission unit 47 is inputted into a base transmission unit 48. For the shown embodiment of the crimping pliers 2, the base transmission unit 48 is built with the transfer element 21 and the drive element 23. The base transmission unit 48 converts a translational movement (for the shown embodiment the translational movement of the transfer element 21 along the longitudinal axis 14-14) in a rotational movement (for the shown embodiment of the drive element 23 around the longitudinal axis 14-14). The changed activation force and activation movement at the output of base transmission unit 48 is input into a further transmission unit 49. For the shown embodiment, the further transmission unit 49 is built with the coupling of the drive element 23 with the pivotable crimping jaws 5. The further transmission unit 49 changes a rotational movement (for the shown embodiment the rotational movement of the drive element 23) into a radial movement of the crimping jaws 5 versus the longitudinal axis 14-14 (for the shown embodiment by means of a pivoting movement of the crimping jaws 5 around the pivoting axes 32). The crimping jaws building the nest 45 are pressed against the outer surface of the crimped connecting element. During the whole crimping movement the longitudinal axis of the nest 45 for the connecting element has an orientation coaxial to the longitudinal axis 14-14. The connecting element is introduced along the longitudinal axis 14-14 into the nest 45 and removed in the opposite direction at the end of the crimping process.

In FIG. 2 the drawing plane defines a plane 50. The longitudinal axis 14-14 and the hand levers 3, 4 as well as the middle axis extend in the plane 50. The longitudinal axis 14-14 divides the plane 50 into an upper half-plane 53 and a lower half-plane 51. For the shown embodiment, the two hand levers 3, 4 are located in the lower half-plane 51. However, it is possible that the hand levers 3, 4 have any different orientation. For example, it is possible that differing from the shown embodiment the two hand levers are located in the lower half-plane 51 having any different opening angle. According to one embodiment of the invention, the middle axis 52-52 of the hand levers 3, 4 has an orientation transverse or perpendicular to the longitudinal axis 14-14 in the half-plane 51. However, the present invention also comprises embodiments having only one single cam discs acting upon the cam follower with an axial offset to the plane wherein the hand levers are moved and wherein the longitudinal axis 14-14 as well as other moved elements transferring the force to the nest 45 are also offset to the plane, wherein the hand levers are moved.

The housing 6 comprises an hollow inner space 56 for housing the relevant parts of the transfer or transmission mechanisms, in particular the pivoting axis 8, the bearing bolt 9, the cam 10, the cam follower 13, the sleeve 18, the rod 16, the supporting disc 19, the transfer element 21, the pins 22, the drive element 23, the sleeve 26, the crimping jaws 5. The transmission units 47 to 49 are located in the housing. Only the hand lever 3 protrudes, at least during a part of the crimping process, out off the housing 6.

It is also possible that the crimping tool comprises a set of exchangeable heads for a plurality of crimping jaws, for a different number of crimping jaws, for different cross-sections of the crimped connecting element and for different cross-sections to be crimped. Different heads and components of the crimping pliers might be exchangeable, whereas other components of the crimping pliers or the transmission mechanism, of the housing and/or the hand levers might be kept when exchanging the aforementioned components. In such manner, a compact and cost-saving set might be built that is ready for being adapted for a great number of different connecting elements.

Differing from the shown embodiment, it is also possible that a translational relative movement of the hand levers 3, 4 might be used for transferring the activation force and movement via the transmission mechanism to the crimping jaws 5.

Furthermore, it is possible that the hand levers 3, 4 are only for a partial movement located within the same half-plane 51, whereas for the other partial movement one hand lever is moved out off the half-plane 51.

Many variations and modifications may be made to the preferred embodiments of the invention without departing substantially from the spirit and principles of the invention. All such modifications and variations are intended to be included herein within the scope of the present invention, as defined by the following claims.

We claim:

1. A crimping tool for crimping connecting elements comprising:

a) crimping jaws building a nest for the connecting element, said crimping jaws being designed and arranged for being moved in radial direction versus a longitudinal axis of the nest for applying radial crimping forces upon the connecting element, b) hand levers for manually applying the crimping forces and causing the movement of said crimping jaws, c) said hand levers being located in a plane, said plane being aligned with the longitudinal axis of said nest and being divided by the longitudinal axis into two half-planes, wherein both of said hand levers are completely located in one and the same half-plane, d) a transfer or transmission unit for transferring a translational activation along the longitudinal axis in the force flow between said hand levers and said crimping jaws into a rotational activation around the longitudinal axis.

2. The crimping tool of claim 1, wherein one of said hand levers is movable with respect to a housing of said crimping tool, whereas the other of said hand levers is fixedly linked with said housing of said crimping tool.

3. The crimping tool of claim 2, wherein said crimping tool comprises an outer shape similar to a pistol, said crimping jaws being located at a muzzle of the pistol and said nest being built by said crimping jaws having a longitudinal axis aligned with the muzzle, one of said hand levers being fixedly connected with said housing building the handle of the pistol and the other of said hand levers being movably linked with said housing building an elongated trigger of the pistol.

4. The crimping tool of claim 1, wherein at least three crimping jaws are provided being forced in radial inner direction versus the longitudinal axis of said connecting element upon manual activation of said hand levers.

5. The crimping tool of claim 1, wherein in the force flow between said hand levers and said crimping jaws an additional transfer or transmission unit is provided transferring a pivoting or rotational activation into a translational activation.

6. The crimping tool of claim 5, wherein said additional transfer or transmission unit comprises a pivotable cam being designed and arranged such that a relative movement of said hand levers is correlated with a pivoting movement of said cam, wherein the cam abuts a cam follower having a translational degree of freedom.

7. The crimping tool of claim 1, wherein said transfer or transmission unit comprises a transfer element and a rotatable drive element having a guiding groove which is inclined with respect to the longitudinal axis, said transfer element having a pin which slidably engages said guiding groove of said drive element.

8. The crimping tool of claim 1, wherein a further transfer or transmission unit is provided transferring a rotational activation in the force flow between said hand levers and said crimping jaws into an activation of said crimping jaws in radial inner direction versus the longitudinal axis.

9. The crimping tool of claim 5, wherein a further transfer or transmission unit is provided transferring a rotational activation in the force flow between said hand levers and said crimping jaws into an activation of said crimping jaws in radial inner direction versus the longitudinal axis.

10. The crimping tool of claim 8, wherein in said further transfer or transmission unit said crimping jaws are rotatable with respect to pivoting axes being fixed at said housing and having an orientation parallel to the longitudinal axis and wherein in said further transfer or transmission unit a pivoting movement of said crimping jaws around said pivoting axes is caused by a coupling between said drive element and said crimping jaws, wherein the coupling is eccentrically to said pivoting axes linked with said crimping jaws.

11. The crimping tool of claim 9, wherein in said further transfer or transmission unit said crimping jaws are rotatable with respect to pivoting axes being fixed at said housing and having an orientation parallel to the longitudinal axis and wherein in said further transfer or transmission unit a pivoting movement of said crimping jaws around said pivoting axes is caused by a coupling between said drive element and said crimping jaws, wherein the coupling is eccentrically to said pivoting axes linked with said crimping jaws.

12. The crimping tool of claim 10, wherein a) said crimping jaws are pivotably linked with a sleeve fixed against said housing, wherein said sleeve determines said pivoting axes, b) said drive element being designed and arranged for being rotated within said sleeve, c) said transfer element comprising a pin protruding in radial outward direction and engaging the inclined guiding groove, d) a coupling axis rotatably couples said crimping jaws with said drive element and e) the distance of said coupling axis from said pivoting axis or said longitudinal axis is variable.

13. The crimping tool of claim 11, wherein a) said crimping jaws are pivotably linked with a sleeve fixed against said housing, wherein said sleeve determines said pivoting axes, b) said drive element being designed and arranged for being rotated within said sleeve, c) said transfer element comprising a pin protruding in radial outward direction and engaging the inclined guiding groove, d) a coupling axis rotatably couples said crimping jaws with said drive element and e) the distance of said coupling axis from said pivoting axis or said longitudinal axis is variable.

14. The crimping tool of claim 1, wherein a spring element is interposed in the force flow between said hand levers and said crimping jaws.

15. The crimping tool of claim 1, comprising a return spring biased by a manual activation of said hand levers, wherein one base of said return spring is directly or indirectly fixed at said housing and the other base of said return spring is fixed at an element being moved with the manual activation of said hand levers.

16. The crimping tool of claim 1, comprising a locking unit designed and arranged for securing a plurality of crimping steps.

* * * * *